US009212584B2

(12) United States Patent
Hahn

(10) Patent No.: US 9,212,584 B2
(45) Date of Patent: Dec. 15, 2015

(54) METHOD FOR OPERATING AN INTERNAL COMBUSTION ENGINE, AND CONTROL UNIT SET UP FOR CARRYING OUT THE METHOD

(71) Applicant: Volkswagen AG, Wolfsburg (DE)

(72) Inventor: Hermann Hahn, Hannover (DE)

(73) Assignee: VOLKSWAGEN AG, Wolfsburg (DE)

( * ) Notice: Subject to any disclaimer, the term of this patent is extended or adjusted under 35 U.S.C. 154(b) by 0 days.

(21) Appl. No.: 14/361,088

(22) PCT Filed: Nov. 23, 2012

(86) PCT No.: PCT/EP2012/073470

§ 371 (c)(1),
(2) Date: May 28, 2014

(87) PCT Pub. No.: WO2013/079405

PCT Pub. Date: Jun. 6, 2013

(65) Prior Publication Data

US 2014/0345256 A1 Nov. 27, 2014

(30) Foreign Application Priority Data

Nov. 30, 2011 (DE) ..... 10 2011 087 399

(51) Int. Cl.

| | |
|---|---|
| ***F01N 3/00*** | (2006.01) |
| ***F01N 3/10*** | (2006.01) |
| ***F02D 41/14*** | (2006.01) |
| ***F02D 41/24*** | (2006.01) |

(52) U.S. Cl.

CPC ..... *F01N 3/101* (2013.01); *F02D 41/1454* (2013.01); *F02D 41/1482* (2013.01); *F02D41/1483* (2013.01); *F02D 41/1495* (2013.01); *F02D 41/2474* (2013.01); *F02D 2041/1431* (2013.01)

(58) Field of Classification Search

USPC ..... 60/274, 276, 277, 285; 701/103, 109, 701/112

See application file for complete search history.

(56) References Cited

U.S. PATENT DOCUMENTS 7,162,359 B2 * 1/2007 Yasui ..... 701/109
7,225,609 B2 * 6/2007 Takubo ..... 60/285

(Continued)

FOREIGN PATENT DOCUMENTS

DE 10 2006 047188 4/2008
DE 10 2006 049656 4/2008
DE 10 2007 057632 10/2008

OTHER PUBLICATIONS

International Search Report issued for PCT Patent Application No. PCT/EP2012/073470, mailed Mar. 21, 2013.

*Primary Examiner* — Binh Q Tran

(74) *Attorney, Agent, or Firm* — Pearl Cohen Zedek Latzer Baratz LLP

(57) ABSTRACT

The invention relates to a method for operating an internal combustion engine. According to the method, an exhaust gas produced by the internal combustion engine is conducted across a 3-way catalytic converter arranged in the exhaust duct. A lambda probe detects a value characteristic of an exhaust-gas lambda number upstream of the 3-way catalytic converter, and transmits said value to an engine control unit with an integrated PI or PID regulator. By means of the PI or PID regulator of the engine control unit, through the specification of a setpoint value, a substantially stoichiometric exhaust-gas lambda number is set, and the exhaust-gas lambda number is, with predefined periodic setpoint value variation, deflected alternately in the direction of a lean lambda number and a rich lambda number (lambda modulation). At the start of each setpoint value variation, a pilot-controlled P component with subsequent I component is predefined up to a time t2, wherein the time t2 is defined by means of stored parameters, which characterize a section time behavior, such that the probe signal or a value derived therefrom would have had to have reached the setpoint value specification at said time t2. From the time t2onwards, for a predefinable time period until the end of the respective setpoint value variation, a switch is made to a regulating algorithm which is based on a difference between an actual value and the setpoint value of the lambda probe or a value derived therefrom.

7 Claims, 5 Drawing Sheets

(56) References Cited

U.S. PATENT DOCUMENTS 7,677,223 B2 * 3/2010 Okazaki et al. ..... 123/434
7,845,160 B2 * 12/2010 Takubo ..... 60/285
8,132,400 B2 * 3/2012 Storhok et al. ..... 60/285
8,215,099 B2 * 7/2012 Ono et al. ..... 60/278
8,381,707 B2 * 2/2013 Mizoguchi et al. ..... 123/696

* cited by examiner

METHOD FOR OPERATING AN INTERNAL COMBUSTION ENGINE, AND CONTROL UNIT SET UP FOR CARRYING OUT THE METHOD

CROSS-REFERENCE TO RELATED APPLICATIONS

This application is a National Phase Application of PCT International Application No. PCT/EP2012/073470, International Filing Date Nov. 23, 2012, claiming priority to German Patent Application No. 10 2011 087 399.6, filed Nov. 30, 2011, both of which are hereby incorporated by reference in their entirety.

FIELD OF INVENTION

The invention relates to a method for operating an internal combustion engine, wherein an exhaust gas produced by the internal combustion engine is passed via a 3-way catalytic converter disposed in an exhaust duct.

BACKGROUND OF THE INVENTION

Methods for lambda control in internal combustion engines can be used to reduce the emissions of harmful exhaust gases into the environment. For this purpose, at least one catalytic converter can be disposed in the exhaust system of the internal combustion engine. In order to keep the catalytic converter at an optimal operating point, it is necessary to control the mixture preparation of the internal combustion engine using a lambda controller such as to give a regulated lambda number that is very close to 1.0 at least on average. A lambda probe can be disposed in the exhaust system of the internal combustion engine for generating a measurement signal.

The prior art is inter alia the use of one of the two control methods described below.

A control method is illustrated in FIG. 2 as it is normally applied when using a step change lambda probe. The upper graph shows the probe signal against time and the lower graph shows the controller intervention against time. With said probes the direction of the controller is changed if the probe signal crosses a specified threshold, for example 450 mV, which in this case corresponds to the stoichiometric point (in this case at times t1, t2 and t3). The variation of the signal above or below the respective threshold is not used or exploited further during the control, but the adjustment takes place independently thereof by pre-control, generally by means of a specified P-component and an I-component, which in turn can be dependent on other variables such as for example the operating point.

The relatively slow control rate is disadvantageous with this method, because above or below the control threshold the absolute signal value is not considered further and thus even large mixture deviations are only corrected at the previously determined control rate. Furthermore, it is a disadvantage that the changeover frequency is relatively high and essentially only determined by the path transition time to the probe and the dead time of the probe. There is thus no possibility of definitely specifying the oxygen input to or output from the downstream catalytic converter, so that the conversion efficiency of the catalytic converter is limited.

FIG. 3 illustrates a control method as normally applied when using probes with accurate lambda signals, including away from the stoichiometric point, i.e. generally broadband lambda probes (actual lambda number from the probe signal: bold dark curve; target lambda number at the probe: narrow dark curve; control variable of the controller: bold light curve; target engine lambda number: narrow rectangular wave curve). The modulation is adjusted by means of varying the target lambda number. The control error is determined from the difference between the target value and the measured actual value and is fed to a suitable controller (for example a PID controller). The path characteristic is taken into account if the target engine value is not used for difference computation but the profile of the target engine value is based on the position of the probe, taking into account the path transition time, and said value is used as the target value at the probe position.

The advantage of this method is that the desired lambda number can be set accurately and the controller has a rapid control rate. It is a disadvantage that overshoots of the controller and strong fluctuations of the fuel-air mixture can occur if the stored path characteristic does not agree with the actual path dynamics. This is the case for example if the probe becomes dynamically more sluggish through ageing or contamination. This is illustrated by way of example in FIG. 4 (actual lambda number from the probe signal: bold dark curve; control variable of the controller: bold light curve; target engine lambda number: narrow rectangular wave curve). In this case the probe signal is significantly more sluggish than in FIG. 3. At point in time t1, when the probe signal reaches the target value, the control value has therefore already changed significantly and as a result there are overshoots in the controller and in the lambda number (point in time t2), and the target value can only be regulated to be stable after a delay (point in time t3). This is a disadvantage for the efficiency of the downstream catalytic converter, i.e. increased emissions occur, with greater fluctuations in the fuel-air ratio this can also cause noticeable juddering of the engine.

If the lambda signal is determined from the signal of a step change lambda probe, a controller according to FIG. 3 has yet another disadvantage. A typical characteristic of step change lambda probes is illustrated in FIG. 5. The step change region can be seen, i.e. the region of large signal change, in the region where lambda=1. Current probes respond dynamically more sluggishly in this step change region than in the pure rich or pure weak region. A lambda signal computed from a step change probe signal therefore has a time delay at a change of mixture between rich and weak exhaust gas for the lambda=1 region. This is to be seen in FIG. 4 at the point in time t4. This behavior also leads to overshoots in the control value and as a result in the lambda number for this type of controller, as illustrated at the point in time t5, with the disadvantages described above. Alternatively, the control parameters could be adapted to the reduced dynamics at the lambda=1 point, but the controller would then be significantly slower in the region outside the lambda=1 region than it could actually be.

An approach is already known from DE 10 2006 049 656 A1 as to how advantages of the method in FIG. 3 illustrated can be exploited for probes with inaccurate correlation between the signal and the actual mixture composition in the region away from the stoichiometric point (thus for example step change probes), in which according to the prior art the method illustrated in FIG. 2 is used. It is described there how a changeover of the controller direction only takes place if a probe signal not only exceeds or falls below a signal threshold value, but also a threshold value for a variable derived from the probe signal. This enables a defined oxygen input or output into or out of the catalytic converter to be provided with known accuracy and thus the conversion efficiency of the catalytic converter to be increased. However there remains the disadvantage of the slow correction of mixture deviations.

SUMMARY OF THE INVENTION

One or more of the discussed problems of the prior art can be solved or at least reduced using the method according to the invention for operating an internal combustion engine. According to the method, an exhaust gas produced by the internal combustion engine is passed via a 3-way catalytic converter disposed in the exhaust duct. A lambda probe detects a characteristic variable for an exhaust gas lambda number before the 3-way catalytic converter and passes the same on to an engine controller with an integrated PI controller or PID controller. With the PI controller or PID controller of the engine controller, an essentially stoichiometric exhaust gas lambda number is set up by specifying a target value and the exhaust gas lambda number is alternately deflected towards a weak lambda number and a rich lambda number with a specified periodic target value variation (lambda modulation). At the start of each target value variation, a pre-controlled P component followed by an I component is specified up to a point in time t2, wherein the point in time t2 is specified using a stored parameter characterizing a path time behavior such that the probe signal or a variable derived therefrom must have reached the demanded target value at said point in time t2. A change to the control that is based on a difference between an actual value and the target value of the lambda probe or a variable derived therefrom is made from the point in time t2 for a specifiable time period until the end of the respective target value variation.

The invention is based on the knowledge that a change from the pre-controlled controller setting to (preferably continuous) control brings with it the advantages of the two different controller types without having to accept the described disadvantages of the two controller types.

Preferably, a magnitude of the P component is specified depending on a target amplitude of the target value variation. An I component can then be specified so that the probe signal or a variable derived therefrom would reach the target value at the point in time t2.

A preferred variant of the method provides that, to determine a response time of the lambda probe, a minimum reaction of the lambda probe in comparison to the state before the controller changeover is defined, and the elapsed time from the controller changeover until the minimum response of the lambda probe is recorded as the response time. The response time is preferably only determined, however, if the target value specified by the PI controller or PID controller exceeds a specified minimum magnitude. The response time of the lambda probe can be determined separately for a step from rich to weak and for a step from weak to rich.

Another aspect of the present invention relates to a controller for controlling an operation of an internal combustion engine that is set up to implement the method according to the invention. For this purpose, the controller can contain a computer-readable control algorithm for implementing the method. In an advantageous embodiment the controller is an integral component of the engine controller.

Further preferred embodiments of the invention arise from the other features mentioned in the dependent claims or from the following description.

BRIEF DESCRIPTION OF THE DRAWINGS

The invention is explained below in detail in exemplary embodiments using the associated figures. In the figures.

DETAILED DESCRIPTION OF THE INVENTION

Figure 1:
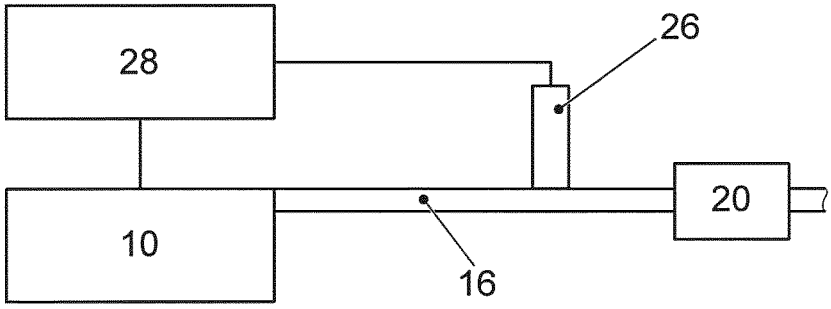
FIG. 1 shows a schematic design of an internal combustion engine with an exhaust system and a 3-way catalytic converter.
Figure 2:
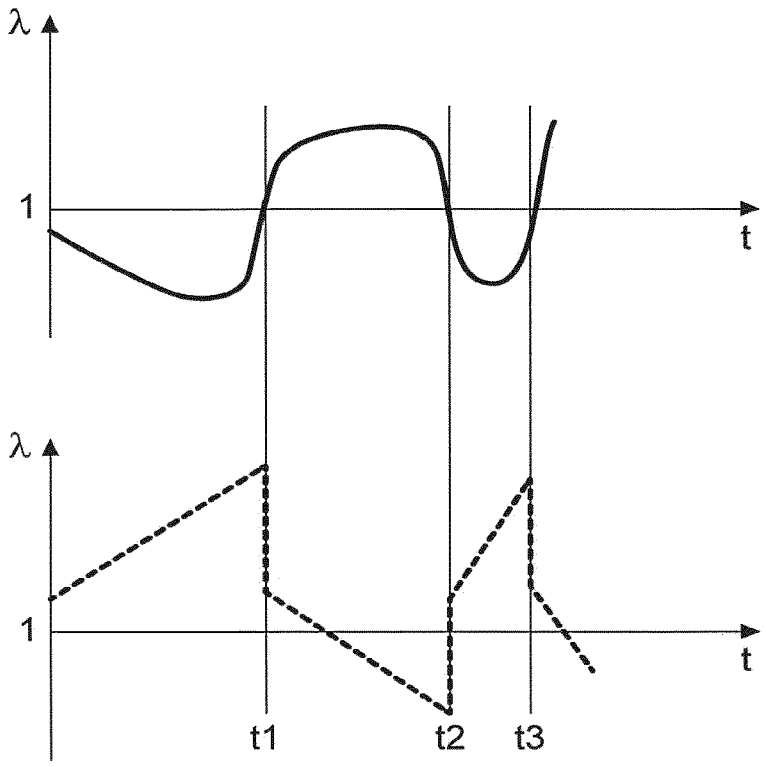
FIG. 2 PRIOR ART
FIG. 2 shows a time profile of the exhaust lambda number upstream of the 3-way catalytic converter and of the controller intervention according to a first variant of the conventional method.
Figure 3:
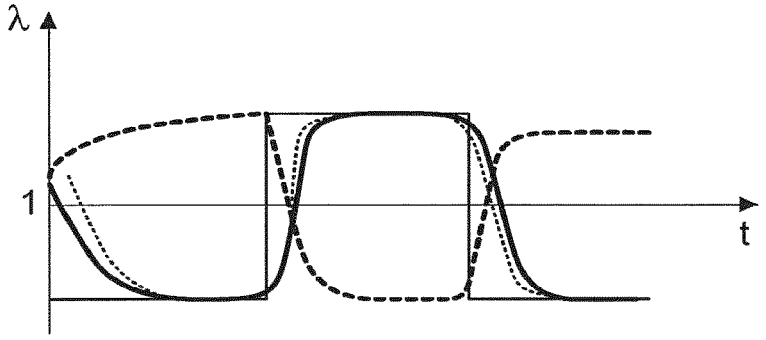
FIG. 3 PRIOR ART
FIG. 3 shows a time profile of the exhaust lambda number upstream of the 3-way catalytic converter and of the controller intervention according to a second variant of the conventional method.

FIG. 1 shows schematically the design of an internal combustion engine 10 with a downstream exhaust system. The internal combustion engine 10 can be an externally ignited engine (OTTO engine). With regard to its fuel supply, it can comprise a direct injection fuel supply, i.e. it can operate with internal mixture formation, or it can comprise a fuel pre-injection means and hence operate with external mixture formation. Moreover, the internal combustion engine 10 can be operated homogeneously, wherein there is a homogeneous air-fuel mixture in the entire combustion chamber of a cylinder at the ignition time point, or in an inhomogeneous mode (stratified charge mode), whereby at the ignition time point there is a relatively rich air-fuel mixture, especially in the region of a spark plug, which is enclosed in the remainder of the combustion chamber by a very weak mixture. It is important within the scope of the present invention that the internal combustion engine 10 can be operated with an essentially stoichiometric air-fuel mixture, i.e. with a mixture with a lambda number close to or equal to 1.

The exhaust system comprises an exhaust manifold, which brings the exhaust gas of the individual cylinders of the internal combustion engine 10 together in an exhaust duct 16. Various exhaust cleaning components can be provided in the exhaust duct 16. Within the scope of the present invention a 3-way catalytic converter 20 disposed in the exhaust duct 16 is significant.

The 3-way catalytic converter 20 comprises a coating of catalytically active components, such as platinum, rhodium and/or palladium, which are applied to a porous catalyst support, e.g. of $Al_2O_3$. The coating further comprises an oxygen storage component, e.g. ceria ($CeO_2$) and/or zirconium oxide ($ZrO_2$), which determines the oxygen storage capacity (OSC) of the 3-way catalytic converter 20. With a stoichiometric or slightly rich exhaust gas atmosphere the 3-way catalytic converter 20 enables nitrogen oxide NOx to be reduced to nitrogen $N_2$ and oxygen $O_2$. In a stoichiometric or slightly weak mode, unburnt hydrocarbons HC and carbon monoxide CO are oxidized to carbon dioxide $CO_2$ and water $H_2O$. With an essentially stoichiometric exhaust gas atmosphere, i.e. with a λ of 1 or close to 1, said conversions practically proceed to completion. Such catalytic coatings are known in the prior art from exhaust gas treatment of OTTO engines and are common. The design and operation of 3-way catalytic converters are thus sufficiently known in the prior art and do not require detailed explanation here.

The exhaust duct 16 can contain various sensors, especially gas and temperature sensors. A lambda probe that is disposed in the exhaust duct 16 at a position close to the engine is illustrated here. The lambda probe 26 can be designed as a step response lambda probe or as a broadband lambda probe and enables conventional lambda control of the internal combustion engine 10, for which it measures the oxygen content of the exhaust gas.

The signals recorded by the different sensors, especially the exhaust gas lambda number measured with the lambda probe 26, pass into an engine controller 28. Similarly, different parameters of the internal combustion engine 10, especially the engine revolution rate and the engine load, are read in by the engine controller 28. Depending on the various signals, a controller implemented in the engine controller 28 thus regulates the operation of the internal combustion engine 10, wherein it especially regulates the fuel supply and the air supply so that a desired fuel quantity and a desired air quantity are delivered in order to present a desired air-fuel mixture (the target exhaust gas lambda). The air-fuel mixture is determined from characteristic fields depending on the operating point of the internal combustion engine 10, especially the engine revolution rate and the engine load.

For improving the cleaning effect of the 3-way catalytic converter 20 it is provided that the internal combustion engine 10 is continuously operated with an essentially stoichiometric average lambda number, wherein the air-fuel ratio delivered to the internal combustion engine 10 is periodically alternately deflected towards a weak lambda number and a rich lambda number with a predetermined oscillation frequency and a predetermined oscillation amplitude about said average lambda number (so-called lambda modulation). The oscillation frequency and the oscillation amplitude are thereby selected such that the 3-way catalytic converter 20 is quasi-continuously regenerated.

Here a continuously stoichiometric operation of the internal combustion engine 10 is understood to mean operation not changing back and forth between a standard operating mode and a regeneration operating mode as is common in the prior art, but operation practically over its entire operating region in the illustrated stoichiometric mode with the lambda oscillation. The internal combustion engine is preferably operated in the illustrated stoichiometric mode over at least 98% of all operating points stored in the operating characteristic field of the controller 28 and this is not interrupted by regeneration intervals.

Furthermore, the term quasi-continuous regeneration of the 3-way catalytic converter 20 is understood to mean that its load state remains essentially constant and especially at an extremely low level. This means that averaged over time there is no increasing loading of the 3-way catalytic converter 20 during a time interval of the order of magnitude of a few lambda oscillations. Preferably, a limit of a maximum of 50% of the maximum loading of the 3-way catalytic converter 20 is not exceeded.

The oscillation frequency and the oscillation amplitude are furthermore selected such that there is a minimum conversion rate of unburnt hydrocarbons (HC) and/or carbon monoxide (CO) and/or nitrogen oxides (NOx) on the 3-way catalytic coating 22, wherein the minimum conversion rate can be aligned with legal limits.

For the most part the oscillation frequency is determined depending on a current operating point of the internal combustion engine 10, especially depending on the engine load and/or engine revolution rate. The oscillation amplitude can also be determined depending on the OSC.

Depending on the various signals that accumulate at the engine controller 28, a controller implemented in the engine controller 28 regulates the operation of the internal combustion engine 10 according to said signals in order to present a desired target exhaust gas lambda.

Controllers automatically influence one or more physical variables to a specified level with a reduction of interference effects. For this purpose, controllers within a control loop continuously compare the signal of the target value with the measured and fed back actual value of the control variable and determine a final control variable influencing the control path such that the control error to a minimum from the difference of the two variables—the control error (control difference). Because the individual control loop elements have a time characteristic, the controller must increase the value of the control error and must simultaneously compensate the time characteristic of the path such that the control variable reaches the target value in the desired manner. Incorrectly adjusted controllers make the control loop too slow, lead to a large control error or to undamped oscillations of the control variable and thereby sometimes to damage of the control path. In general the controllers distinguish between continuous and discontinuous behavior. Among the best known continuous controllers are the "standard controllers" with P, PI, PD and PID characteristics.

For the purposes of the present invention, preferably a linear controller with a proportional, integral and differential characteristic (PID controller) is used. The PID controller therefore consists of the components of the P element, of the I element and of the D element. The P element provides a contribution to the control variable that is proportional to the control error. The I element acts on the control variable by time integration of the control error with a weighting by the integration time. The D element is a differentiator that is only used as a controller in connection with controllers with a P characteristic and/or I characteristic. It does not respond to the magnitude of the control error, but only to its rate of change.

Figure 6:
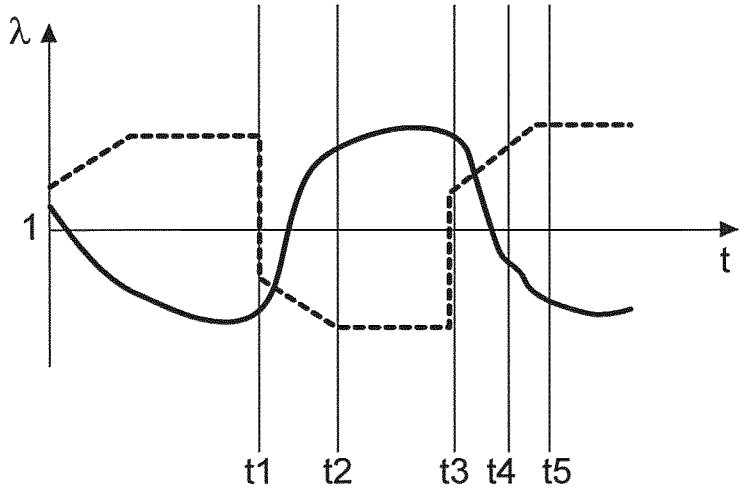
FIG. 6 shows a time profile of the exhaust lambda number upstream of the 3-way catalytic converter and of the controller intervention according to the method according to the invention.

According to the invention, the lambda modulation takes place as illustrated in FIG. 6 (actual lambda number from the probe signal: bold dark curve; control variable of the controller: bold light curve; target lambda number ranges: light rectangular).

The changeover of the controller direction takes place at the point in time t1. Initially a pre-controlled P step (P component for achieving the target value) takes place. The magnitude of the P step can hereby depend on various parameters. Inter alia, the P step can be dependent on a specified target amplitude. In a preferred embodiment it can hereby be specified which proportion of the specified target amplitude should be represented by means of the P step. In addition, the current difference of the probe signals or of a variable (preferably lambda) derived therefrom from the current or future target value or target range is assessed and the P step is additionally made dependent on said difference. In a particularly preferred embodiment, the magnitude of the P step that is necessary to get to the future target value from the current actual lambda number is therefore specified, wherein the desired target value contains the specified component that has been assigned to the P step from the specified target amplitude.

Between the points in time t1 and t2 the controller is further adjusted with a specified I component. The path transition time and the probe response time are known from stored data. The I component is therefore specified such that at the point in time t2 (in the absence of other interference effects) the probe signal or a variable derived therefrom (preferably lambda) is expected to reach the target value or the target range, wherein this signifies the setting of the full desired target amplitude. The I component is thereby dependent on both the path characteristics and also on the specified component of the amplitude at the P step, because the difference between the total amplitude and the specified component of the amplitude for the P step must now be adjusted by means of the I component until the point in time t2.

From the point in time t2 there is now a change from the pre-controlled controller setting to (continuous) control, which is based on the difference between the actual value and the target value of the probe signal or on a variable derived therefrom (preferably lambda).

Figure 4:
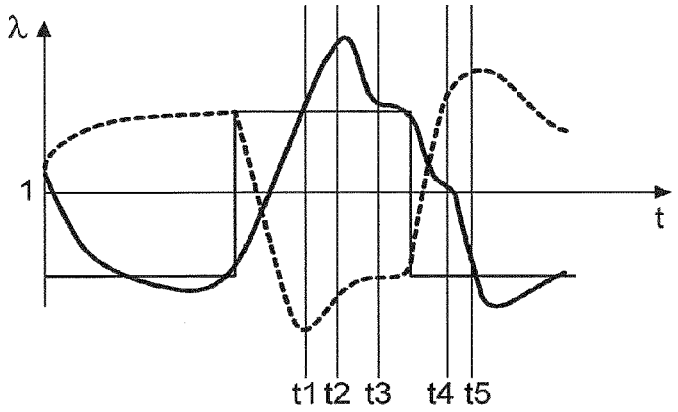
FIG. 4 PRIOR ART
FIG. 4 shows the behavior of the controller for the conventional method according to FIG. 3 for non-matching path parameters.
Figure 5:
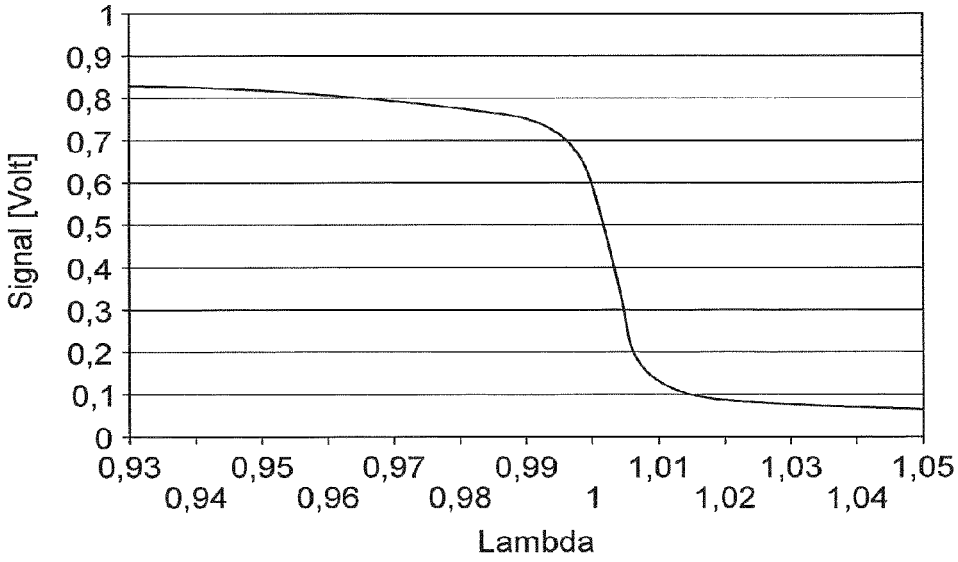
FIG. 5 PRIOR ART
FIG. 5 shows a characteristic of a step change lambda probe for the conventional method according to FIG. 3.

The method thereby combines the advantages of a pre-control and a (continuous) control. The data that are stored for characterizing the path behavior can for example take into account behavior as illustrated in FIG. 4 at the point in time t4. Overshoots are therefore avoided and both lambda and also the control value remain stable. At the same time a rapid control rate and a defined oxygen input or oxygen output into or out of the catalytic converter are achieved, because following expiry of the path response times a change is made to a fast controller, whose parameters can be specified at the lambda=1 point of the probe irrespective of any inertia.

Figure 7:
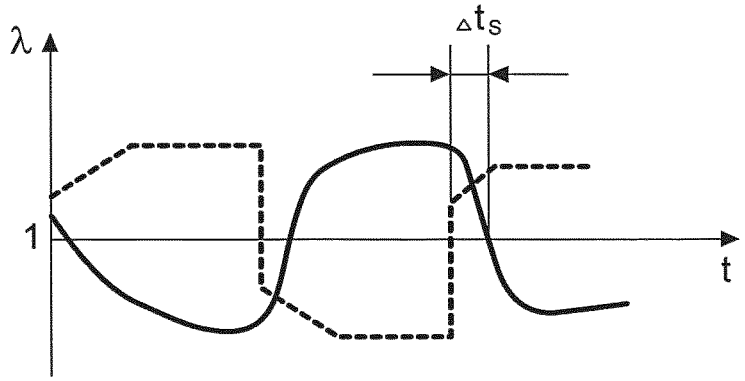
FIG. 7 shows the determination of the step response time according to the method according to the invention.

Furthermore, the dynamics of the probe can also be determined very simply and with good accuracy with the method according to the invention. Because the controller changeover takes place controlled by means of a P step and an I component and the probe signal is not analyzed for control during the time of said pre-controlled control, the step response time illustrated in FIG. 7 can be used to assess the probe dynamics (current lambda number from the probe signal: bold dark curve; control variable of the controller: bold light curve; target engine lambda number: narrow rectangular wave curve; $\Delta t_s$: step response time).

In one preferred embodiment, a minimum response of the probe in comparison to the state before the controller changeover is defined depending on the magnitude of the P step or the mixture adjustment carried out up to the point in time of the determination of the step response time. This can for example be a signal change that corresponds to 20 to 50%, preferably 30%, of the pre-controlled mixture adjustment. The time elapsed from the controller step until reaching the minimum response of the probe gives the step response time.

In one preferred embodiment it is not exactly the actual point in time of the controller changeover that is used as the point in time of the controller changeover for determining the minimum response of the probe, but taking into account the known path parameters the comparison value of the probe is only determined at a specifiable later point in time that is after the controller changeover but before the changed mixture reaches the probe.

This enables dynamic mixture spread, which may have occurred in the engine immediately before the controller changeover, to be taken into account and to not cause errors in the step response times. In another preferred embodiment, a valid step response time is only determined if the pre-controlled controller adjustment had at least a specifiable minimum magnitude.

In another preferred embodiment, following the expiry of a specifiable minimum time since the controller changeover without the probe exhibiting the specified minimum response, the current time or a substitute value is likewise assessed as the valid step response time. The case is thereby taken into account in which the probe signal has a continuously constant value as a result of a fault, i.e. the minimum response would never be achieved and thus no step response time would be determined.

The stored path dead time can be subtracted from the determined step response time and thus the pure probe response time can be determined. The probe response time can be used for producing a maintenance signal if this or a variable derived therefrom exceeds defined threshold values. The probe response time can thereby be considered for assessment separately according to a rich-weak step and a weak-rich step.

Another advantage of the method according to the invention is that for dynamically deteriorating probes the overshoots illustrated in FIG. 4 at the points in time t1 and t2 can easily be prevented, so that the method according to the invention has greater stability and robustness in relation to dynamically deteriorating probes than previously known methods.

For dynamically only slightly deteriorating probes, for determining the point in time t2 in FIG. 6, i.e. the changeover to the fast controller, a certain safety factor can be added to the path transition time parameter. This can for example be carried out with multiplicative and/or additive values. The changeover to the fast controller then takes place somewhat later than would actually be possible for a fast sensor, but only when a slower reacting sensor would also have reached the target signal value.

In another embodiment the probe response time determined as described above can be used for adaptation of the control method. For this purpose, at least one response time is used, preferably the greater of the two probe response times (i.e. response times separated according to a rich-weak step or a weak-rich step). Preferably, suitable time elements for the path parameters are derived from said probe response time. The determination of the point in time t2 in FIG. 6, i.e. the changeover to the fast controller, thereby takes place while taking into account the determined probe response time so that the probe signal or a variable derived therefrom (preferably lambda) has reached the target value at said point in time.

In another preferred embodiment the control parameters of the subsequently activated, continuous control are adapted to the probe response time. In particular, the controller can be made slower for a dynamically poorer probe and thus overshoots are prevented.

REFERENCE CHARACTERS

10 internal combustion engine
16 exhaust duct
20 3-way catalytic converter
22 3-way catalytic coating
26 lambda probe
28 engine controller
$\Delta t_s$ step response time

The invention claimed is:

1. A method for operating an internal combustion engine having air and fuel supplies configured to supply a variable air:fuel mixture to the internal combustion engine, the internal combustion engine producing exhaust gas that is passed via a 3-way catalytic converter disposed in an exhaust duct, said method comprising detecting, via a single lambda probe disposed upstream from the 3-way catalytic converter, a probe signal characteristic of an exhaust gas lambda number and forwards forwarding the probe signal to an engine controller having an integrated PI or PID controller, wherein the PI or PID controller is configured with a target value corresponding to a stoichiometric exhaust gas lambda number, and the air and fuel supplies are configured to vary the air:fuel mixture such that the detected exhaust gas lambda number alternates between a weak lambda number and a rich lambda number ("lambda modulation"), said lambda modulation having a specified periodic target value variation such that, at the start of each target value variation, a pre-controlled P component with following I component is specified up to a point in time t2, wherein the point in time t2 is specified using stored parameters characterizing a path behavior so that, at said point in time t2, the probe signal or a variable derived from the probe signal must have reached the specified target value, wherein, from the point in time t2, a changeover to control based on a difference between an actual value and the target value of the lambda probe takes place for a specifiable time period until the end of the respective target value variation.

2. The method as claimed in claim 1, wherein for, determining a response time of the lambda probe, a minimum response of the lambda probe is defined in comparison to a state before the controller changeover and the time that has passed between the controller changeover and the minimum response of the lambda probe is recorded as the response time.

3. The method as claimed in claim 2, wherein the response time is only determined if the target value specified by the PI controller or PID controller exceeds a specified minimum magnitude.

4. The method as claimed in claim 2, wherein the response time of the lambda probe is recorded separately for a rich-weak step and a weak-rich step.

5. The method as claimed in claim 1, wherein a magnitude of the P component is specified depending on a target amplitude of the target value variation.

6. The method as claimed in claim 5, wherein the I component is specified such that the probe signal or the variable derived from the probe signal has reached the target value at the point in time t2.

7. An engine controller for controlling an operation of an internal combustion engine, wherein the engine controller is configured to perform the method as claimed in claim 1.

* * * * *